US011039731B2

(12) United States Patent
Han

(10) Patent No.: US 11,039,731 B2
(45) Date of Patent: Jun. 22, 2021

(54) NESTING, DISH DRYING RACK

(71) Applicant: Hongyuan Han, New Vernon, NJ (US)

(72) Inventor: Hongyuan Han, New Vernon, NJ (US)

( * ) Notice: Subject to any disclaimer, the term of this patent is extended or adjusted under 35 U.S.C. 154(b) by 0 days.

(21) Appl. No.: 16/704,751

(22) Filed: Dec. 5, 2019

(65) Prior Publication Data

US 2020/0178759 A1 Jun. 11, 2020

Related U.S. Application Data

(60) Provisional application No. 62/776,131, filed on Dec. 6, 2018.

(51) Int. Cl.
*A47L 19/04* (2006.01)

(52) U.S. Cl.
CPC ..... *A47L 19/04* (2013.01)

(58) Field of Classification Search
CPC ..... A47L 19/02; A47L 19/04; A47F 5/005; A47B 77/06; A47B 81/04; A47J 47/20; A47G 23/03
USPC ..... 211/41.3, 41.5, 41.6; 220/572, 571, 487, 220/488
See application file for complete search history.

(56) References Cited

U.S. PATENT DOCUMENTS 591,377 A * 10/1897 Bunce ..... A47L 19/04 220/572
605,336 A * 6/1898 Perrottet ..... B65D 7/26 220/6
801,499 A * 10/1905 Yonkers ..... A47L 19/04 220/572
990,454 A * 4/1911 Peters ..... A47L 19/04 211/41.5
1,389,908 A * 9/1921 Shults ..... A47L 19/04 211/85.25
3,025,967 A * 3/1962 Christophersen ..... A47L 19/00 211/41.5
3,027,041 A * 3/1962 Stansbury, Jr. ..... A47L 19/04 220/572
3,800,957 A * 4/1974 Krause ..... A47L 19/04 211/41.3
4,169,638 A * 10/1979 Cirasuolo ..... A47L 19/04 211/41.6
4,799,744 A * 1/1989 Toy ..... A47J 47/16 211/184
5,385,261 A * 1/1995 Lippisch ..... A47L 19/02 220/23.83
5,704,492 A * 1/1998 Bartko ..... A47J 47/20 211/41.3

(Continued)

*Primary Examiner* — Jennifer E. Novosad
(74) *Attorney, Agent, or Firm* — Preti Flaherty Beliveau & Pachios LLP

(57) ABSTRACT

A drying rack which can be nested during shipment and/or storage includes an upper portion having a first and second drying areas. The drying areas define a gap between their lower extents. The drying rack also includes a baseboard portion to catch liquid draining through the first drying area and a baseboard extension configured to move between a first position and a second position. In the first position, the baseboard extension extends beneath the second drying area so as to catch liquid draining through the second drying area and, in the second position, the baseboard extension overlaps the baseboard portion exposing the gap between the first drying area and the second drying area so as to enable nesting of the drying rack with other like-designed drying racks.

18 Claims, 18 Drawing Sheets

(56) References Cited

U.S. PATENT DOCUMENTS 6,170,676 B1 * 1/2001 Patadia ..... A47L 19/04 211/41.3
6,179,134 B1 * 1/2001 Pine ..... A47L 19/04 211/41.3
6,357,605 B1 * 3/2002 Martorella ..... A47L 19/04 211/41.5
6,502,704 B2 * 1/2003 Martorella ..... A47L 19/04 211/41.5
6,543,069 B1 * 4/2003 Nelson ..... A47L 19/04 211/41.3
D490,198 S * 5/2004 Jerstroem ..... D32/55
6,763,954 B1 * 7/2004 Travers ..... A47L 19/02 211/41.3
6,769,538 B2 * 8/2004 Oswald ..... A47G 29/08 206/457
D534,701 S * 1/2007 Schmidt ..... D32/55
7,407,059 B2 * 8/2008 Sullivan ..... A47L 19/04 211/41.3
7,424,949 B2 * 9/2008 Kumar ..... A47K 5/03 206/77.1
7,458,470 B2 * 12/2008 Jerstroem ..... A47L 19/04 211/41.4
8,037,999 B1 * 10/2011 Kumar ..... A47K 5/03 206/77.1
8,074,813 B2 * 12/2011 Yang ..... A47L 19/04 211/41.3
8,087,108 B2 * 1/2012 Burns ..... A47J 47/20 4/657
8,196,771 B1 * 6/2012 Gathings ..... B65D 1/24 220/556
D692,199 S * 10/2013 Huang ..... D32/55
8,763,818 B1 * 7/2014 Pargansky ..... A47L 17/00 211/41.3
8,794,455 B2 * 8/2014 Yang ..... A47L 19/04 211/41.3
D757,384 S * 5/2016 Duvigneau ..... D32/55
9,351,570 B2 * 5/2016 Koefelda ..... A47B 55/00
9,382,057 B2 * 7/2016 Prommel ..... A47L 19/04
9,427,135 B2 * 8/2016 Audet ..... A47L 19/04
9,427,136 B2 * 8/2016 Kent ..... A47L 19/04
9,730,571 B1 * 8/2017 Lee ..... A47L 19/04
9,907,453 B2 * 3/2018 Green ..... A47L 19/00
10,674,890 B1 * 6/2020 Armstrong ..... A47L 19/04
10,827,884 B2 * 11/2020 Stevens ..... A47B 77/14
2002/0056717 A1 * 5/2002 Hwang ..... B65D 21/022 220/835
2005/0040120 A1 * 2/2005 Pine ..... A47L 19/04 211/41.6
2006/0283817 A1 * 12/2006 Yang ..... A47L 19/04 211/41.4
2007/0090063 A1 * 4/2007 Schmidt ..... A47L 19/04 211/41.3
2008/0149644 A1 * 6/2008 Piacenza ..... A47L 19/04 220/572
2008/0283480 A1 * 11/2008 Segall ..... A47L 19/02 211/41.6
2010/0059460 A1 * 3/2010 Mulaw ..... A47L 19/04 211/41.3
2012/0138550 A1 * 6/2012 Wisniewski ..... A47L 19/04 211/41.3
2020/0178759 A1 * 6/2020 Han ..... A47L 19/04
2020/0245845 A1 * 8/2020 Klug ..... A47L 19/02

* cited by examiner

NESTING, DISH DRYING RACK

BACKGROUND OF THE INVENTION

Various embodiments relate generally to drying racks and, more specifically, relate to dish drying racks capable of nesting within each other.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Consumer goods such as plastic drying racks may be molded as a single, unitary piece. This simplifies the process of fabrication. Drying racks may also be made from metal wire alone or in combination with plastic, bamboo or other materials. A conventional configuration for a drying rack usually includes an enclosed space or receptacle which may be used for holding utensils.

However, a single piece consumer product such as a unitary drying rack suffers from several drawbacks. First, the product itself requires a larger amount of space for storage and display in a retail setting. Thus, a retailer is able to stock and display fewer products per unit volume. Second, an elongated frame results in a more cumbersome product for transportation and storage by a consumer. Third, a fixed, elongated frame necessitates larger product packaging. Fourth, such a frame means fewer finished products may be shipped per unit volume from a manufacturer to a distributor and to the retailer. Finally, an elongated frame increases the risk of breakage during shipment, on display in a retail setting, and during transportation by a consumer. Collectively, these drawbacks mean higher costs for the manufacturer, distributor, and retailer, a more expensive product for the consumer, and a less resilient product.

BRIEF SUMMARY OF THE INVENTION

The below summary is merely representative and non-limiting.

The above problems are overcome, and other advantages may be realized, by the use of the embodiments.

In a first aspect, an embodiment provides a drying rack that can be nested during shipment and/or storage. The drying rack includes an upper portion defining a drying area and a movable divider configured to move from a first configuration, where the divider lays flat against the bottom of the drying area, to a second configuration, where the divider subdivides the drying area to define a utensil drying area. The drying rack also includes a removable baseboard that can attach in a first position beneath the upper portion so as to catch liquid draining through the upper portion, and can be placed in a second position within the upper portion and above the divider while the divider is flat against the bottom of the drying area. The upper portion includes one or more wall in the drying area and one or more walls define one or more subsections of the utensil drying area. The removable baseboard defines, for each of the walls, an associated notch configured to surround the associated wall when the removable baseboard is placed in the second position.

In another aspect, an embodiment provides a further drying rack that can be nested during shipment and/or storage. The drying rack includes an upper portion having a first drying area and a second drying area. The first drying area and the second drying area define a gap between lower extents of the first drying area and the second drying area. The drying rack also includes a baseboard portion configured to catch liquid draining through the first drying area; and a baseboard extension configured to move between a first position and a second position. In the first position, the baseboard extension extends beneath the second drying area so as to catch liquid draining through the second drying area and, in the second position, the baseboard extension at least partially overlaps the baseboard portion exposing the gap between the first drying area and the second drying area so as to enable nesting of the drying rack with other like-designed drying racks.

BRIEF DESCRIPTION OF THE SEVERAL VIEWS OF THE DRAWINGS

Aspects of the described embodiments are more evident in the following description, when read in conjunction with the attached Figures.

DETAILED DESCRIPTION OF THE INVENTION

This patent application claims priority from U.S. Provisional Patent Application No. 62/776,131, filed Dec. 6, 2019, the disclosure of which is incorporated by reference herein in its entirety.

Various embodiments provide a dishrack design that has a removable baseboard (or drainer board) that, when attached to the drying rack part of the product, allows the dishrack to nest easily with similarly designed dishracks in order to lower the overall size of multiple units during transportation and when placed on retail shelves by retailers, to maximize their selling shelf space efficiencies.

The drainer board may be configured to both attach to either the bottom of the dishrack, for example, during normal use, and to be securely stowed within the dishrack, for example, for storage or transportation. The drainer board may be snapped in to place or retained using various techniques.

The dishrack may also include a divider that be moved (for example, by being rotated around a pivot point) from a flat position, where the divider is positioned against the bottom of the drying surface, to a raised position, where the divider separates a utensil drying area from the dish drying area. This utensil drying area may be used to keep smaller items, such as flatware, upright for faster drying.

Figure 1:
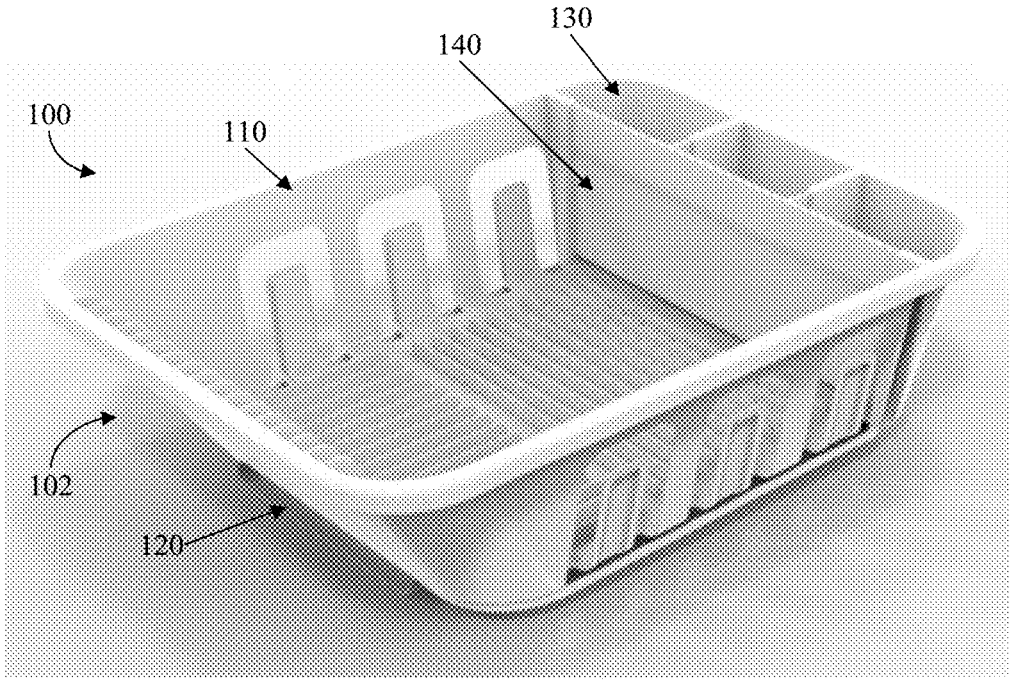
FIG. 1 is a first view of a nesting, dish drying rack in accordance with a first embodiment, the nesting, dish drying rack being in a first configuration where a movable divider is raised.
Figure 2:
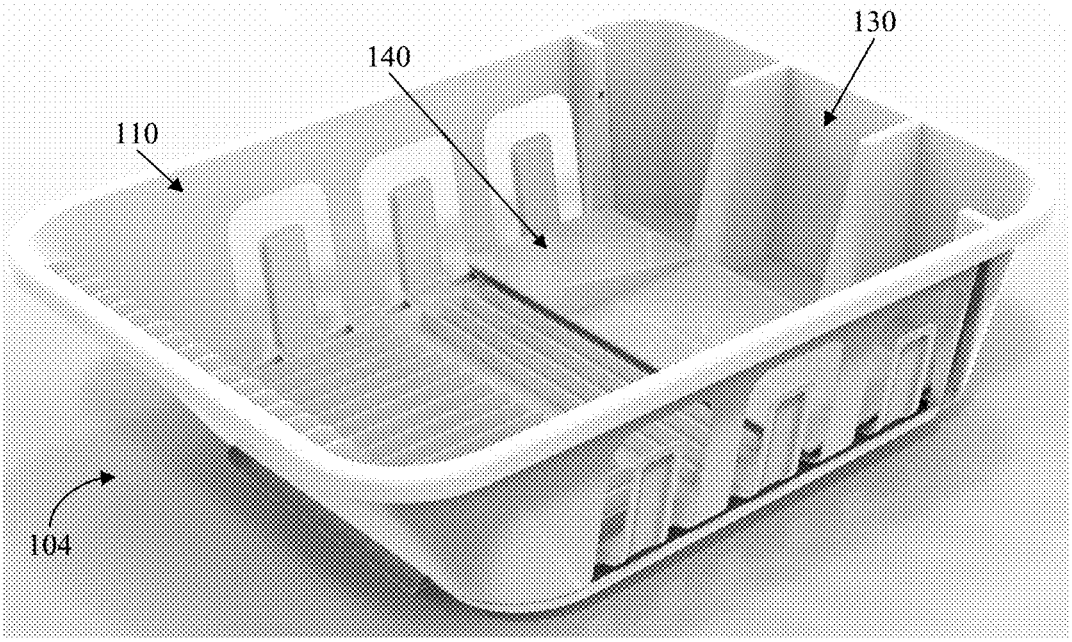
FIG. 2 is a second view of the nesting, dish drying rack of FIG. 1 in a second configuration where the movable divider is lowered.
Figure 3:
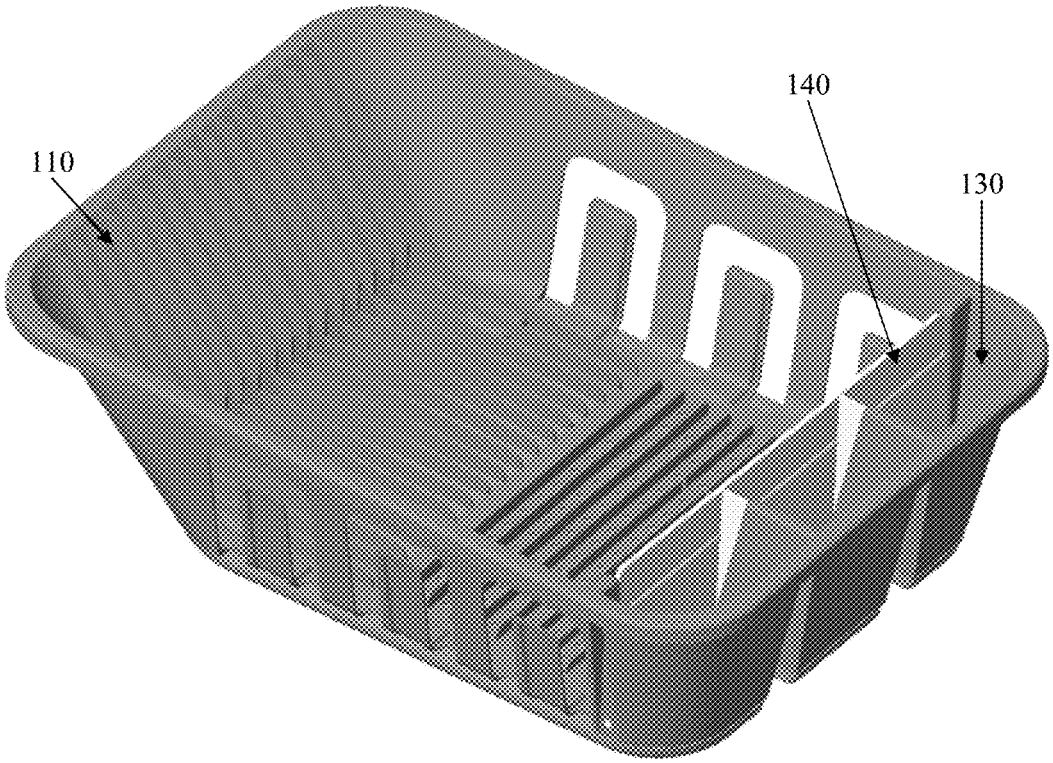
FIG. 3 is a rotated view of the nesting, dish drying rack of FIG. 1 in the first configuration.
Figure 4:
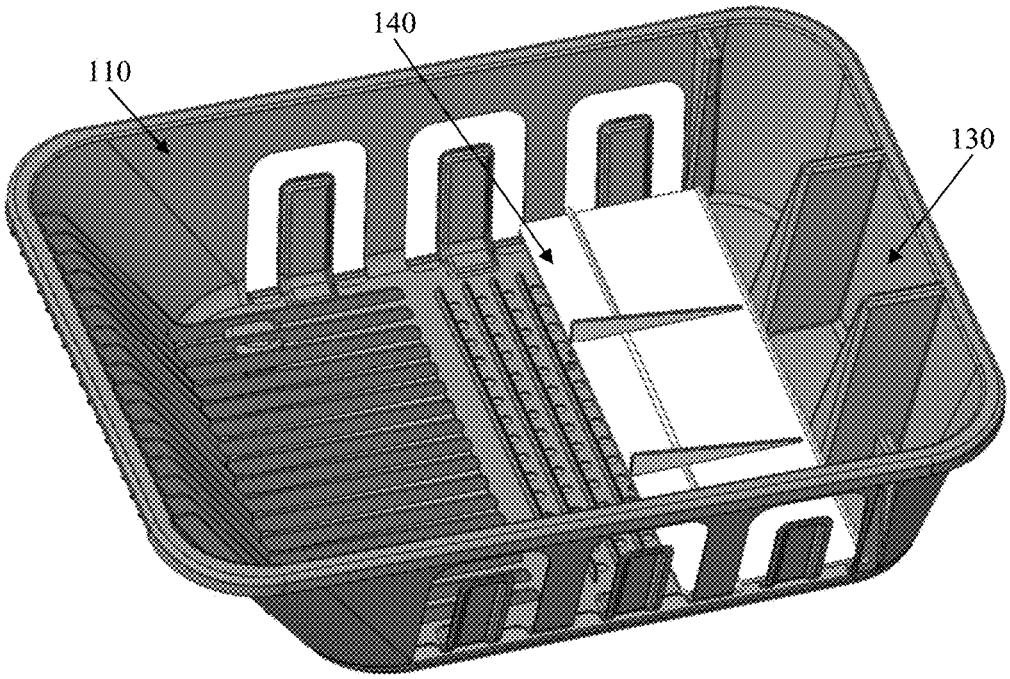
FIG. 4 is a further view of the nesting, dish drying rack of FIG. 1 in the second configuration.
Figure 5:
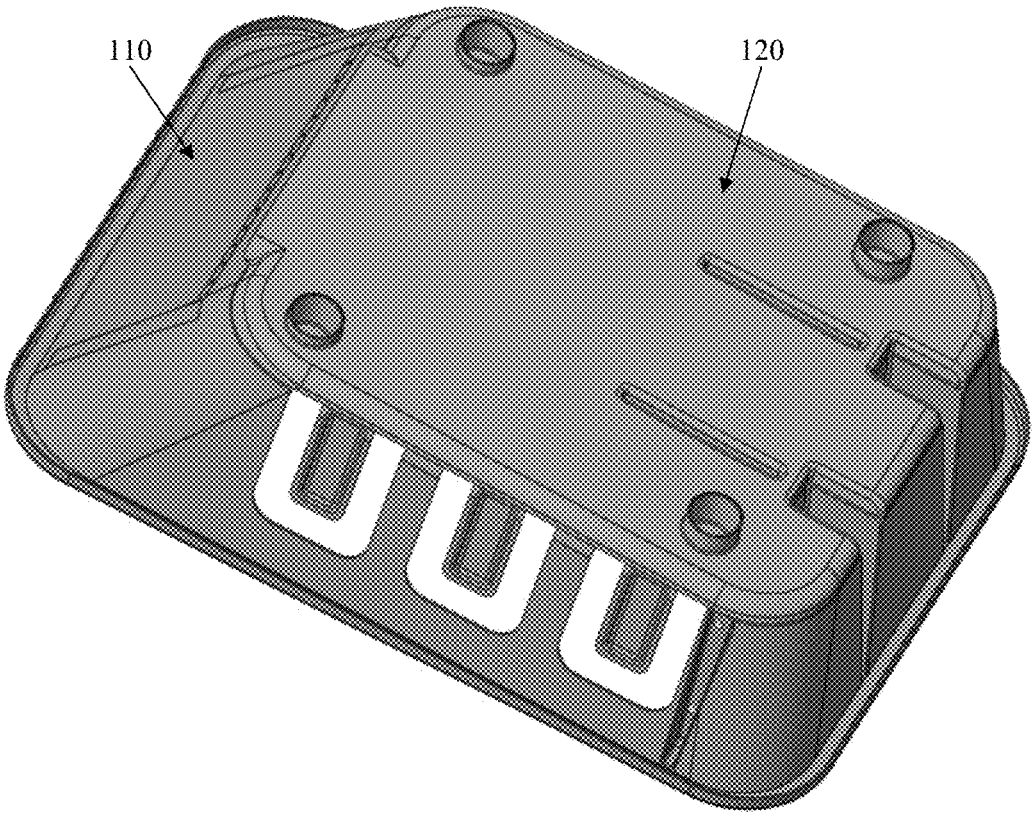
FIG. 5 is a bottom view of the nesting, dish drying rack of FIG. 1 showing additional features of a removable baseboard.
Figure 6:
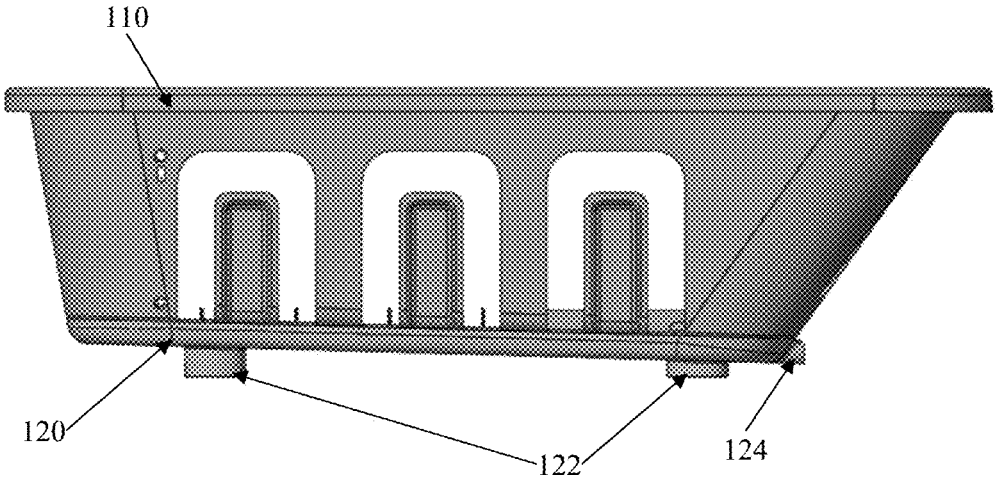
FIG. 6 is a side view of the nesting, dish drying rack of FIG. 1 in the first configuration.
Figure 7:
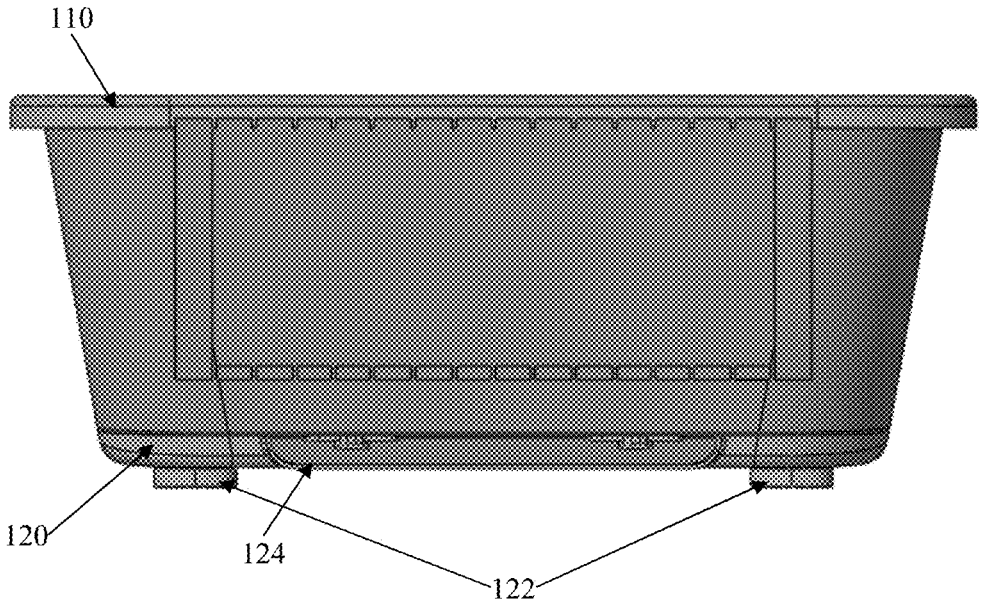
FIG. 7 is a front view of the nesting, dish drying rack of FIG. 1.
Figure 8:
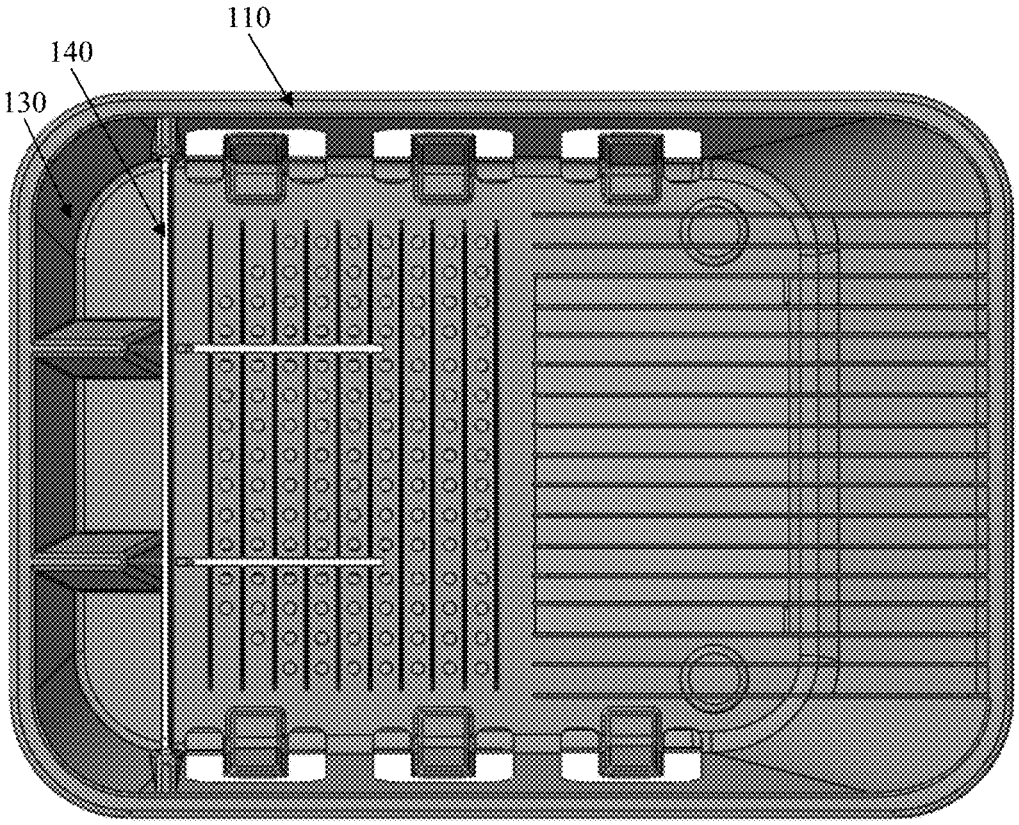
FIG. 8 is an upper view of a nesting, dish drying rack of FIG. 1 in the first configuration.
Figure 9:
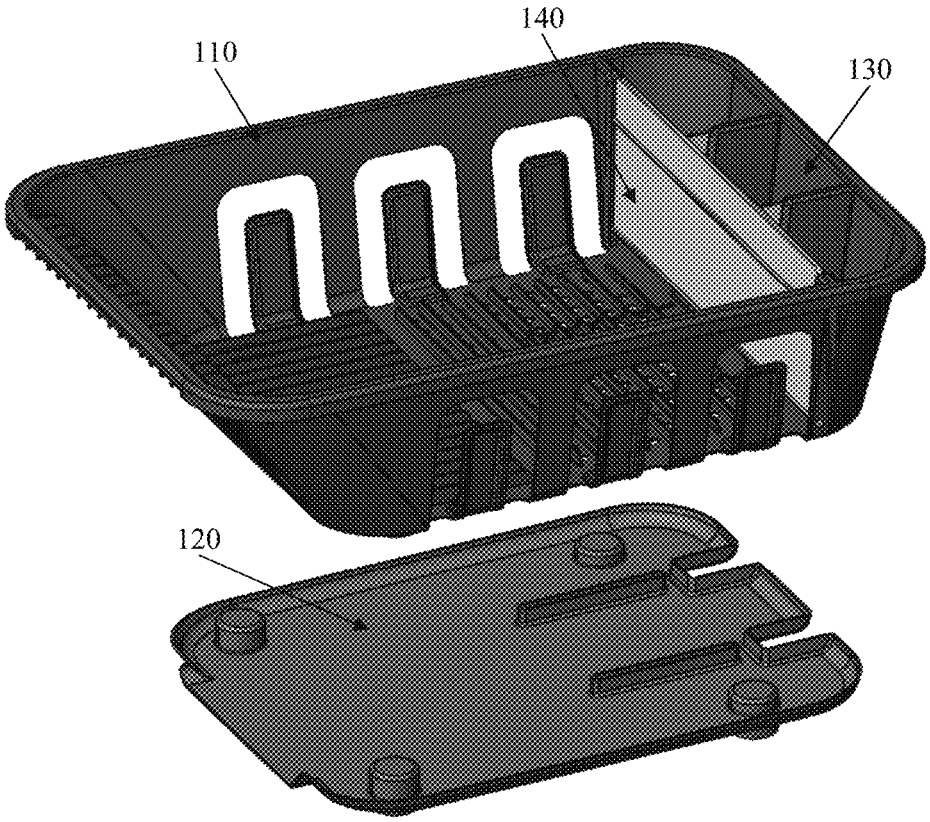
FIG. 9 is a view of a nesting, dish drying rack of FIG. 1 in the first configuration and with the removable baseboard separated.

FIG. 1 is a first view of a nesting, dish drying rack 100 where a movable divider 140 is in a first, raised configuration 102 and FIG. 2 is a second view of the nesting, dish drying rack 100 of FIG. 1 where the movable divider 140 is in a in a second, lowered configuration 104. FIGS. 3-8 are further views of the nesting, dish drying rack 100 of FIG. 1. FIG. 9 is another view of the nesting, dish drying rack 100 of FIG. 1 showing the removable baseboard 120 separated from the upper drying portion 110.

As shown in FIGS. 1-9, the drying rack 100 includes an upper drying portion 110 and a removable baseboard 130. The upper drying portion 110 has a movable divider 140 which allows separation of a utensil holding area 130. The removable baseboard 120 features baseboard feet 122 and a spout 124. The baseboard feet 122 may include a non-slip surface to avoid unwanted movement of the drying rack 100.

The movable divider 140 includes at least one retaining structure, such as a bulge or protrusion. Each retaining structure can cooperate with a mating structure on the upper portion, such as a recess or opening, and maintain the movable divider in the first configuration 102.

Figure 10:
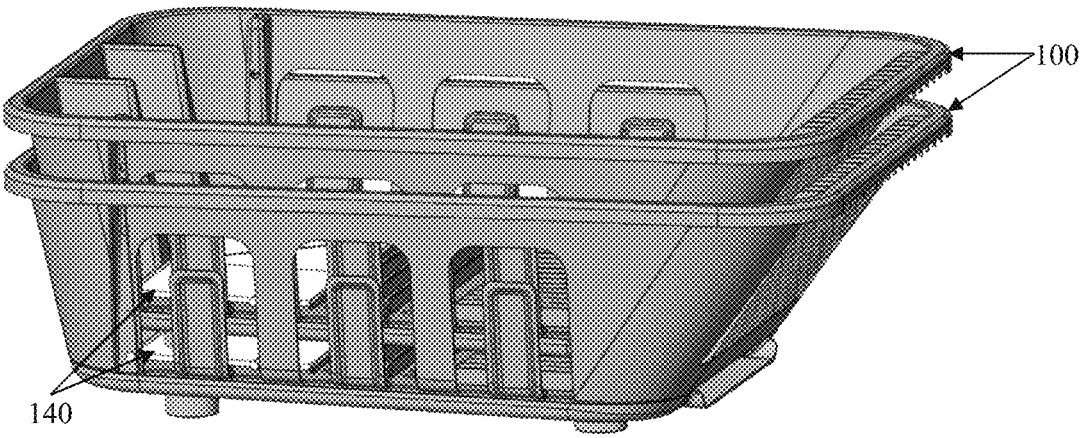
FIG. 10 is a view of two nesting, dish drying racks of FIG. 1 in the second configuration, wherein the two nesting, dish drying racks are nested.
Figure 11:
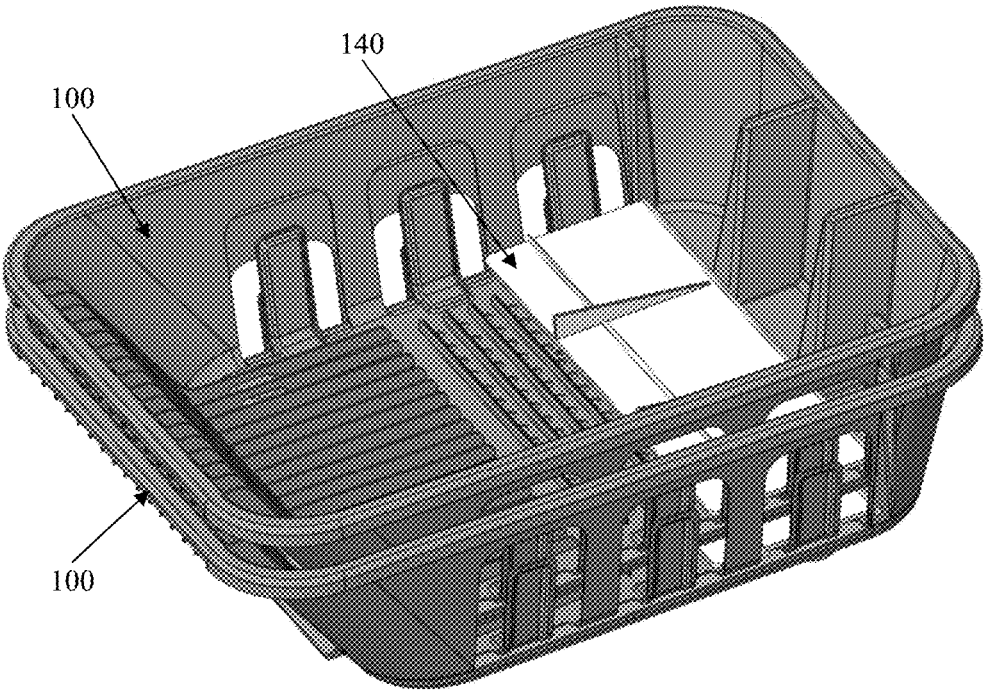
FIG. 11 is another view of two nesting, dish drying racks of FIG. 1 in the second configuration and nested as in FIG. 10.
Figure 12:
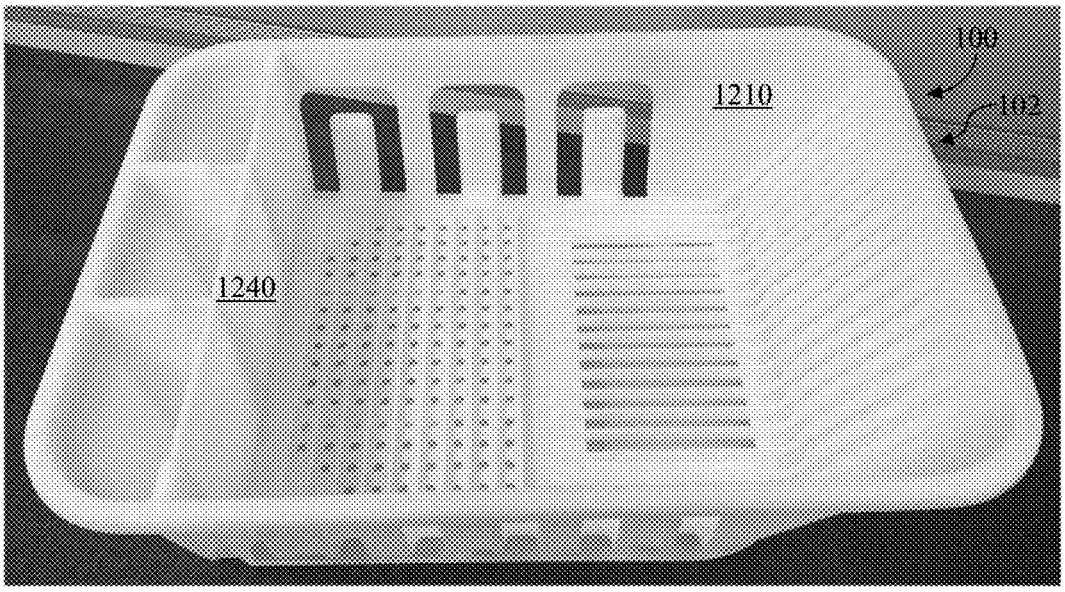
FIG. 12 is a view of a nesting, dish drying rack in accordance with a second embodiment, the nesting, dish drying rack being in a first configuration where a movable divider is raised.
Figure 13:
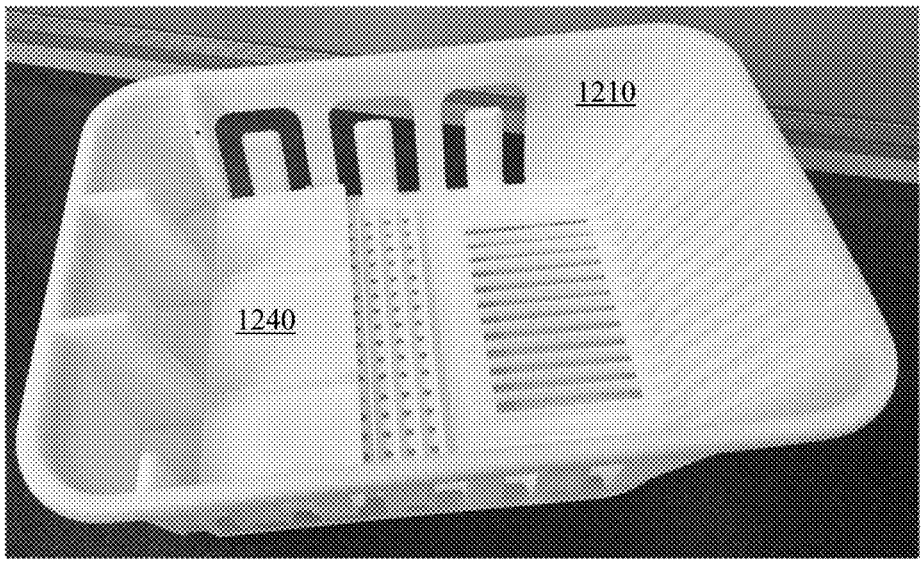
FIG. 13 is a view of the nesting, dish drying rack of FIG. 12 in a second configuration where the movable divider is lowered.
Figure 14:
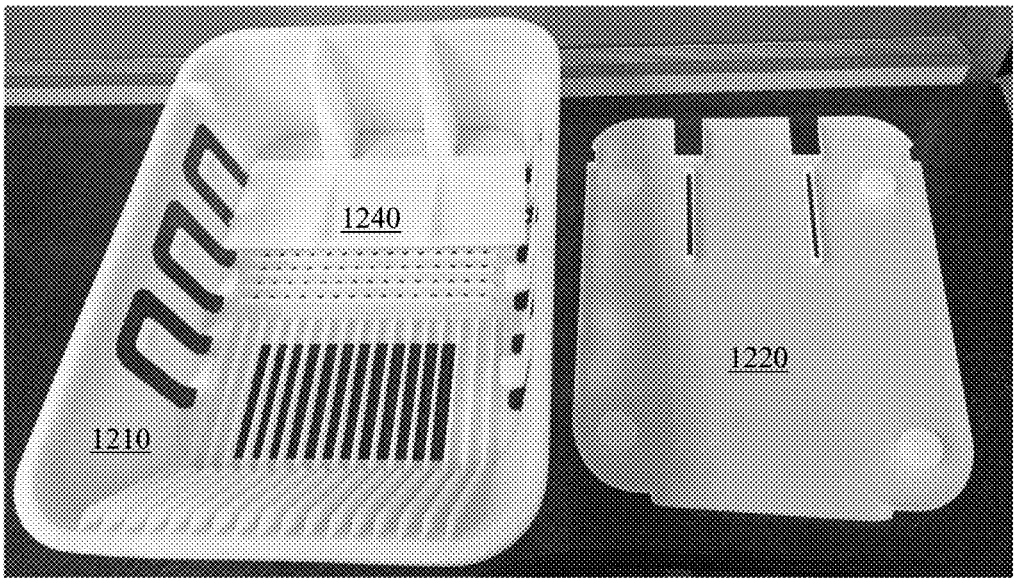
FIG. 14 is a view of the nesting, dish drying rack of FIG. 12 where a removable baseboard has been removed from the bottom of the nesting, dish drying rack.
Figure 15:
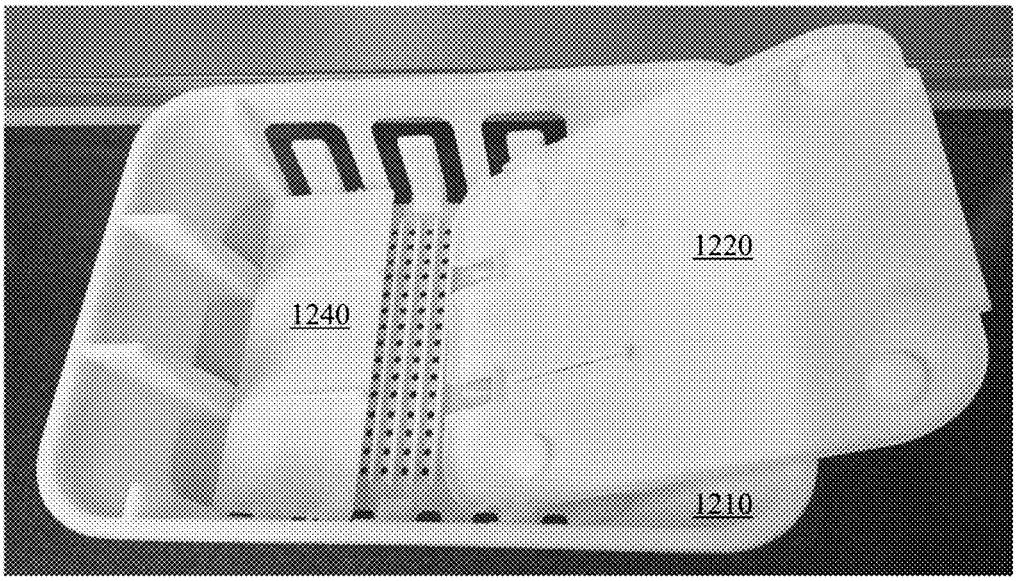
FIG. 15 is a view of the nesting, dish drying rack of FIG. 12 where the removable baseboard has been partially placed into the upper portion of the nesting, dish drying rack.
Figure 16:
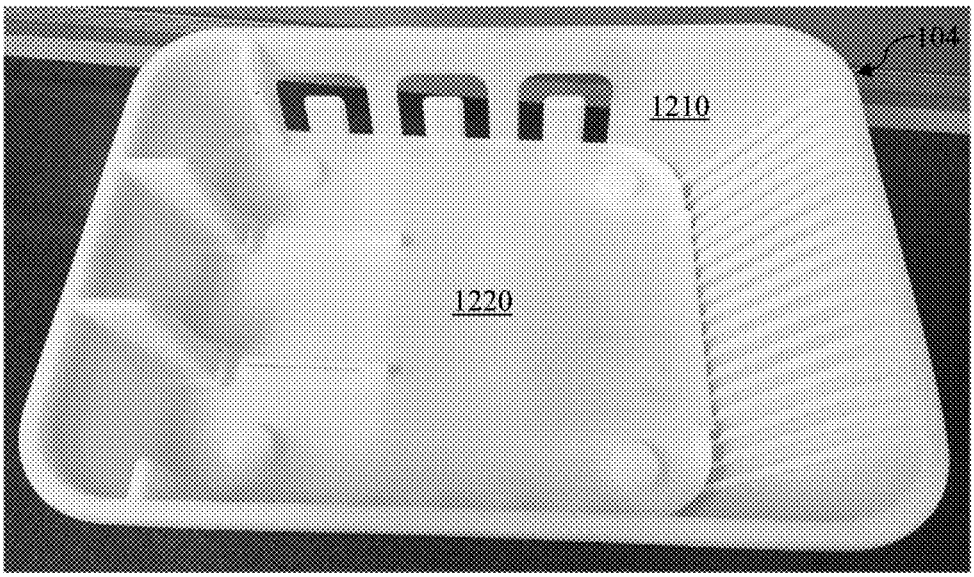
FIG. 16 is a view of the nesting, dish drying rack of FIG. 12 where the removable baseboard has been fully placed into the upper portion of the nesting, dish drying rack.

FIGS. 10-11 are views of two nesting, dish drying racks 100 of FIG. 1, wherein the two nesting, dish drying racks 100 are nested. As shown, the movable dividers 140 of the two nesting, dish drying racks 100 are in the second, lowered configuration 104 so as to facilitate the nesting of the drying racks 100. The upper most drying rack 100 may alternatively be in the first, raised configuration 102.

FIGS. 12-16 show a nesting, dish drying rack 1200 where the rack 1200 is transitioned from one configuration for use to a second configuration for storage or transportation. The process begins by laying down the divider 1240, removing the drainer board 1220 and placing the drainer board into the upper drying rack portion 1210.

Figure 17:
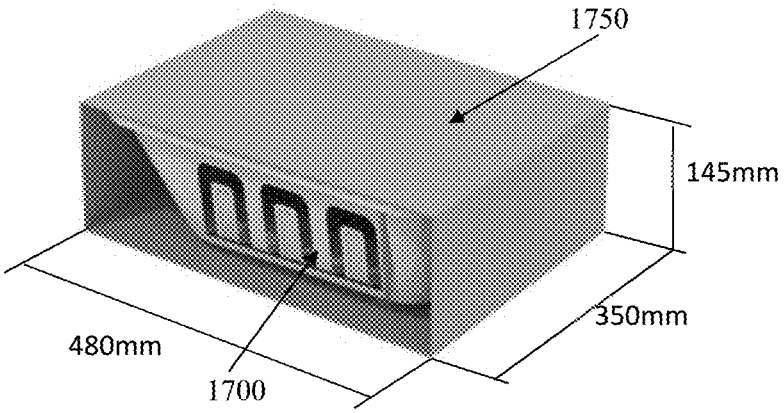
FIG. 17 is a view of a nesting, dish drying rack in accordance with a third embodiment, where the nesting, dish drying rack has been packaged for shipping/storage.
Figure 18:
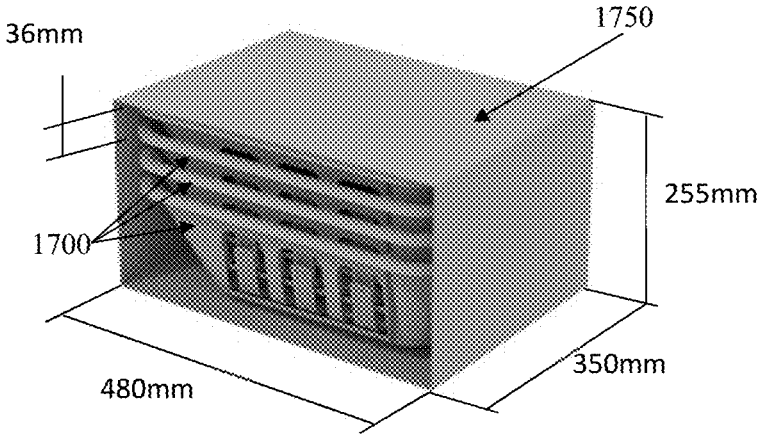
FIG. 18 is a view of four of the nesting, dish drying racks of FIG. 17, where the nesting, dish drying racks have been packaged for shipping/storage in a single box.
Figure 19:
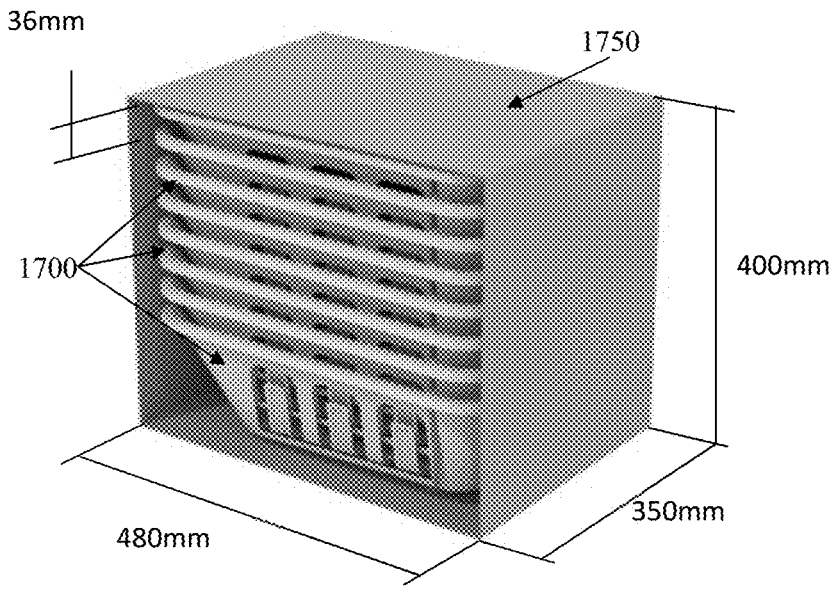
FIG. 19 is a view of eight of the nesting, dish drying racks of FIG. 17, where the nesting, dish drying racks have been packaged for shipping/storage in a single box.
Figure 20:
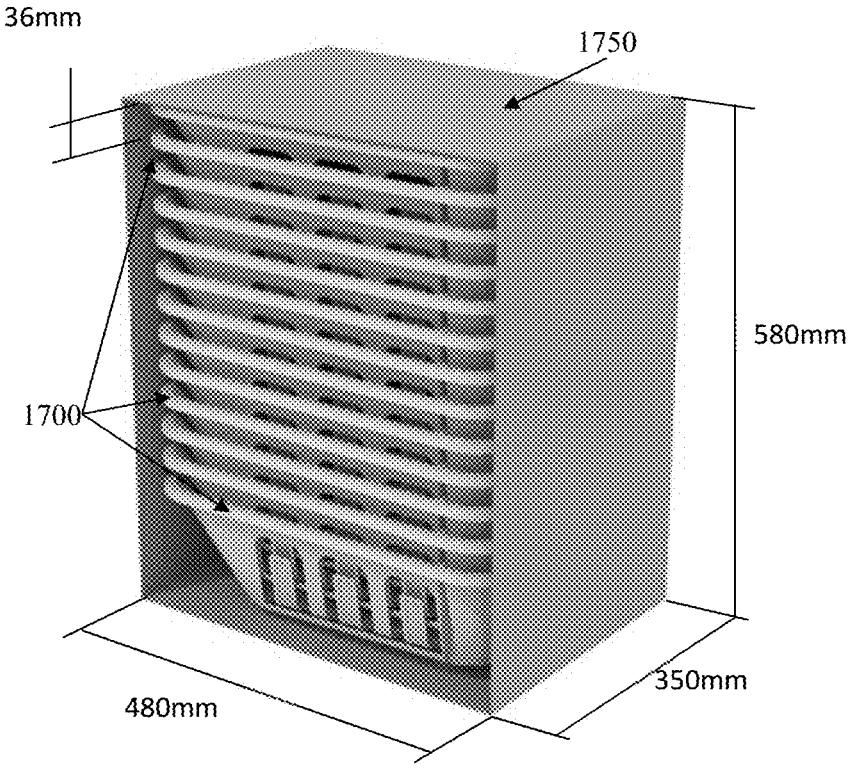
FIG. 20 is a view of thirteen of the nesting, dish drying racks of FIG. 17, where the nesting, dish drying racks have been packaged for shipping/storage in a single box.

FIGS. 17-20 show various sets of the nesting, dish drying rack 1700 that have been placed in a package 1750 for shipping/storage. As the drying racks 1700 are able to be nested, there is a substantial reduction in size when shipping/storing multiple drying racks 1700 when compared to shipping/storing individual drying racks 1700 (as shown in FIG. 17). When nested, each additional drying rack 1700 after the first adds only a small portion of its height (e.g., 36 mm) to the stack height.

Figure 21:
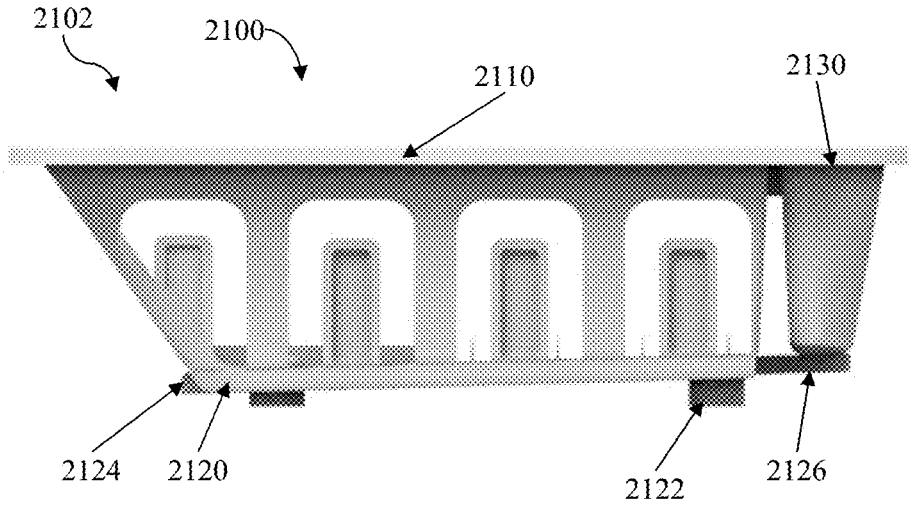
FIG. 21 is a first view of a nesting, dish drying rack in accordance with a further embodiment, the nesting, dish drying rack being in a first configuration where an extension of the baseboard is extended beneath the utensil holding area.
Figure 22:
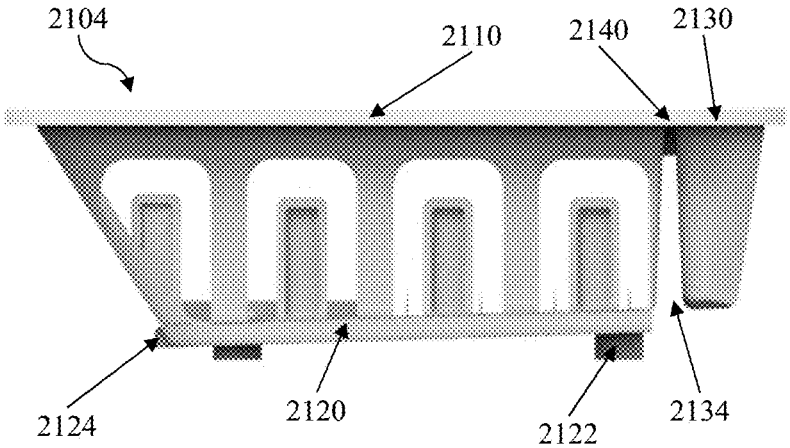
FIG. 22 is another view of the nesting, dish drying rack of FIG. 21, the nesting, dish drying rack being in a second configuration where an extension of the baseboard is retracted.
Figure 23:
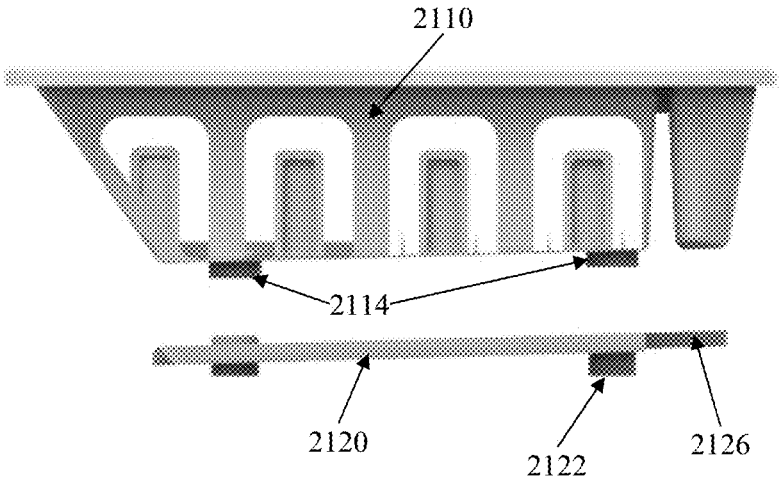
FIG. 23 is a separated view of the nesting, dish drying rack of FIG. 21 in the first configuration.
Figure 24:
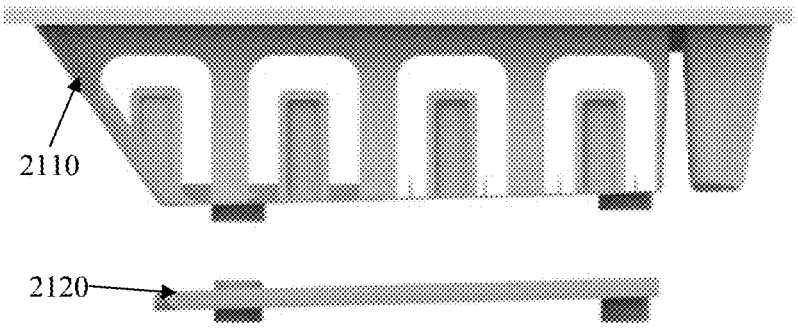
FIG. 24 is a separated view of the nesting, dish drying rack of FIG. 21 in the second configuration.
Figure 25:
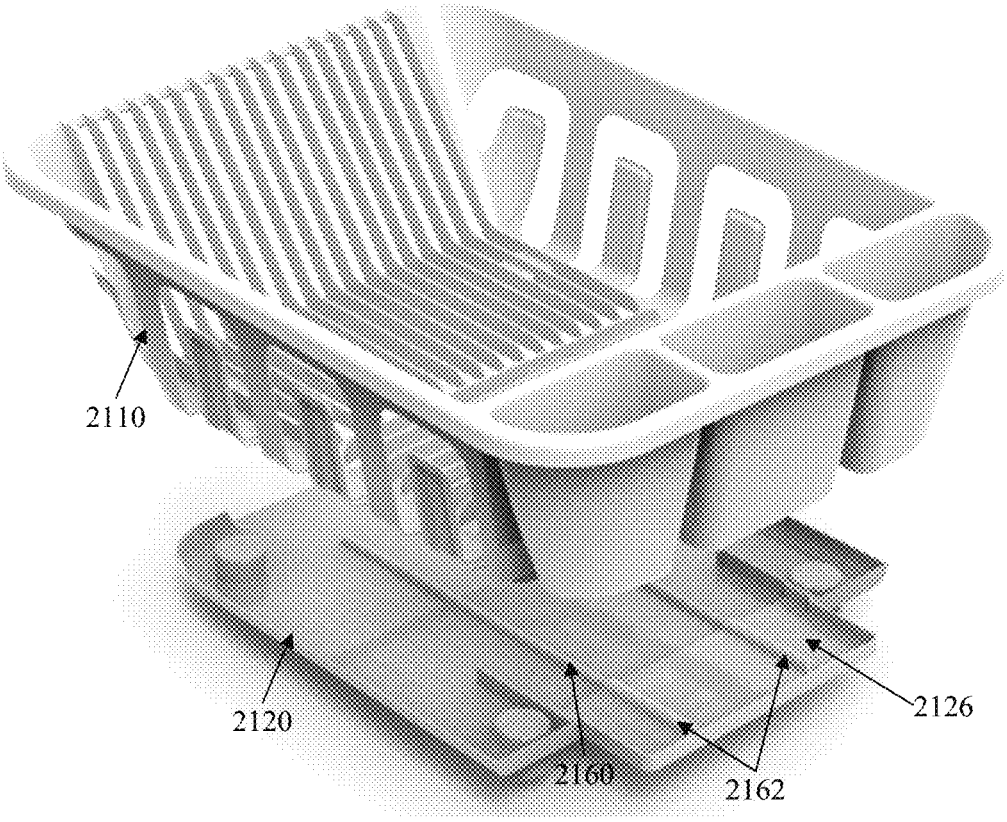
FIG. 25 is another separated view of the nesting, dish drying rack of FIG. 21 in the first configuration.
Figure 26:
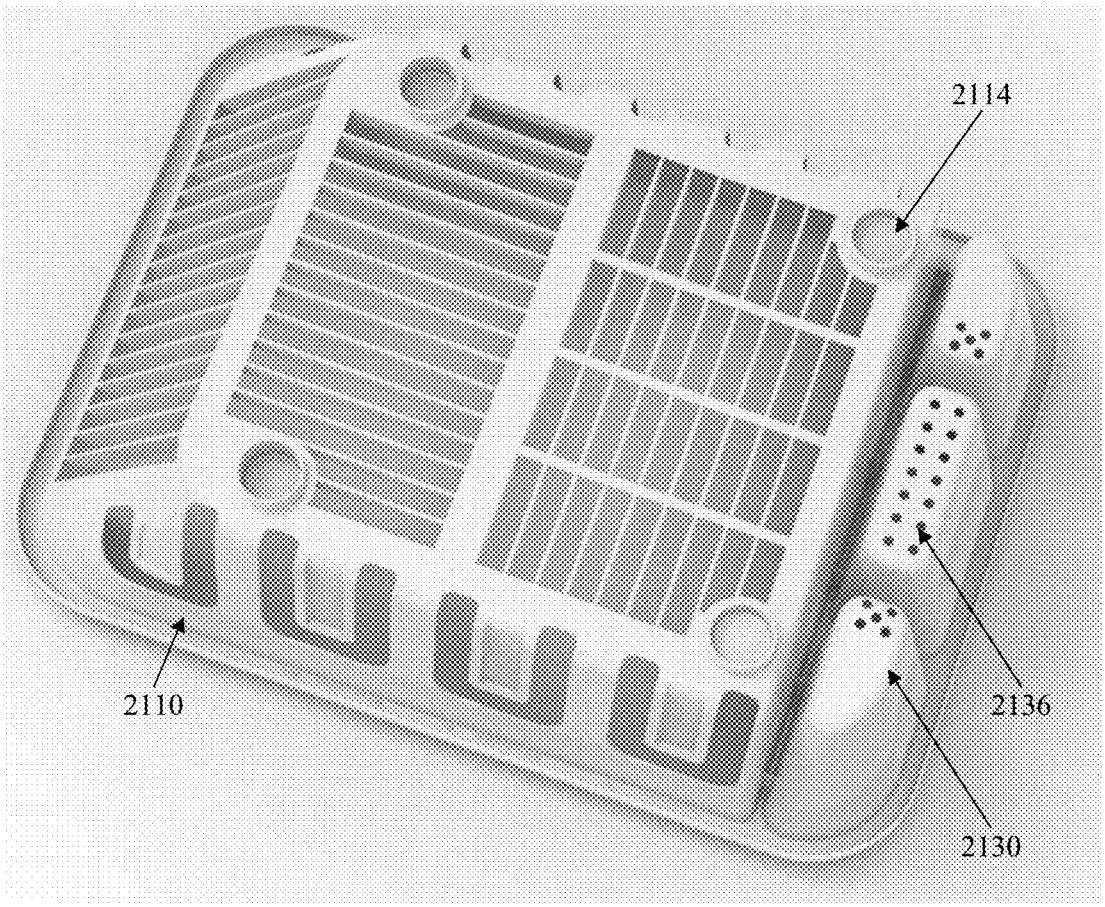
FIG. 26 is a view of the bottom of the nesting, dish drying rack of FIG. 21.
Figure 27:
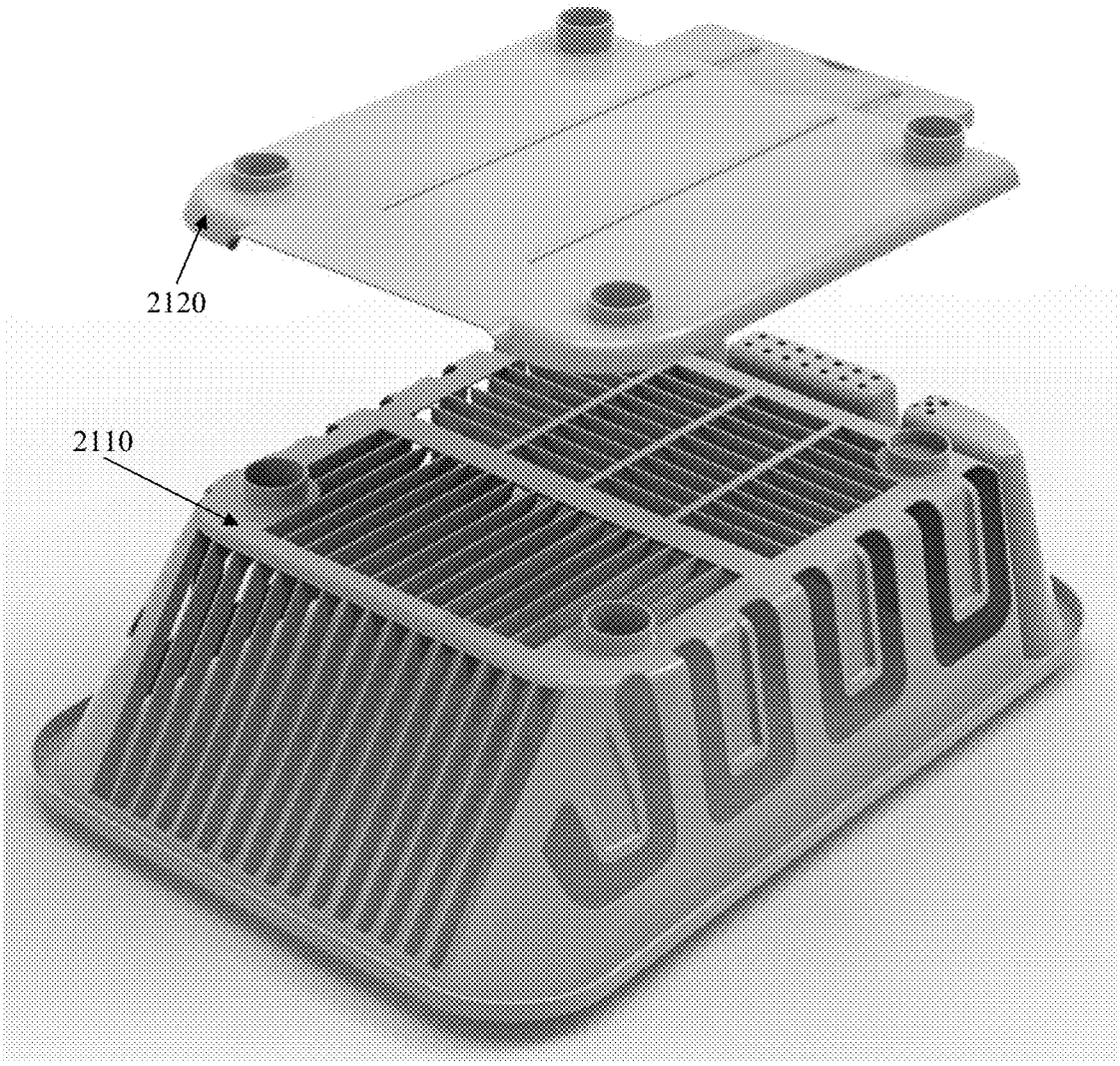
FIG. 27 is a further separated view of the nesting, dish drying rack of FIG. 21 in the first configuration.
Figure 28:
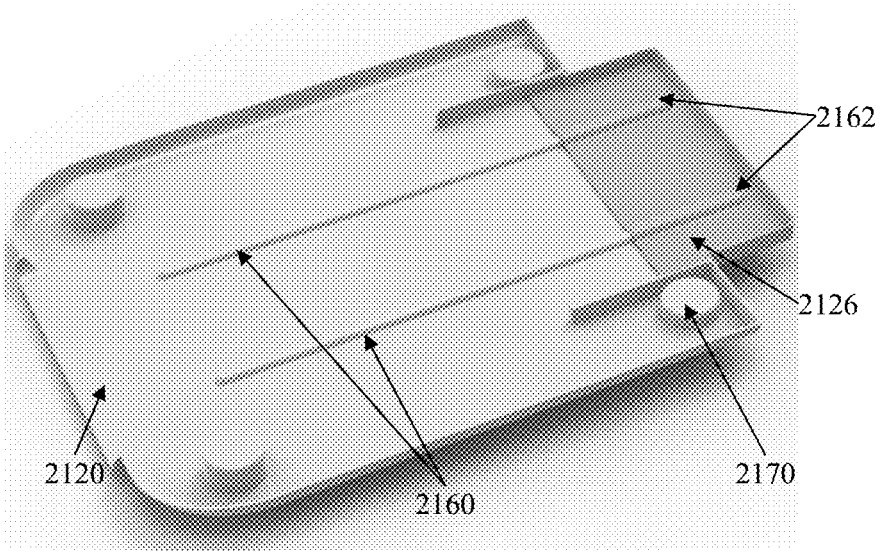
FIG. 28 is a view of the baseboard of the nesting, dish drying rack of FIG. 21 in the first configuration.
Figure 29:
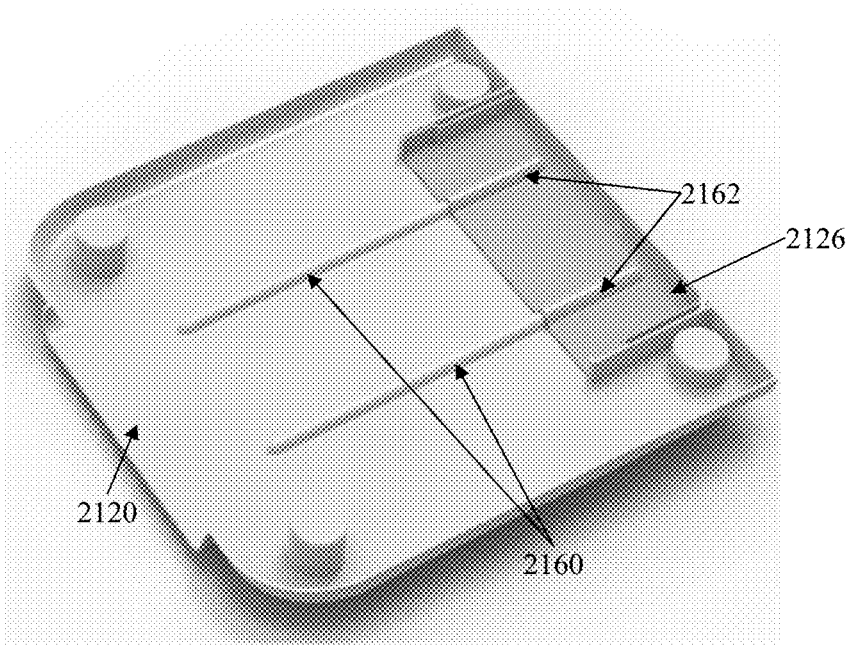
FIG. 29 is a view of the baseboard of the nesting, dish drying rack of FIG. 21 in the second configuration.
Figure 30:
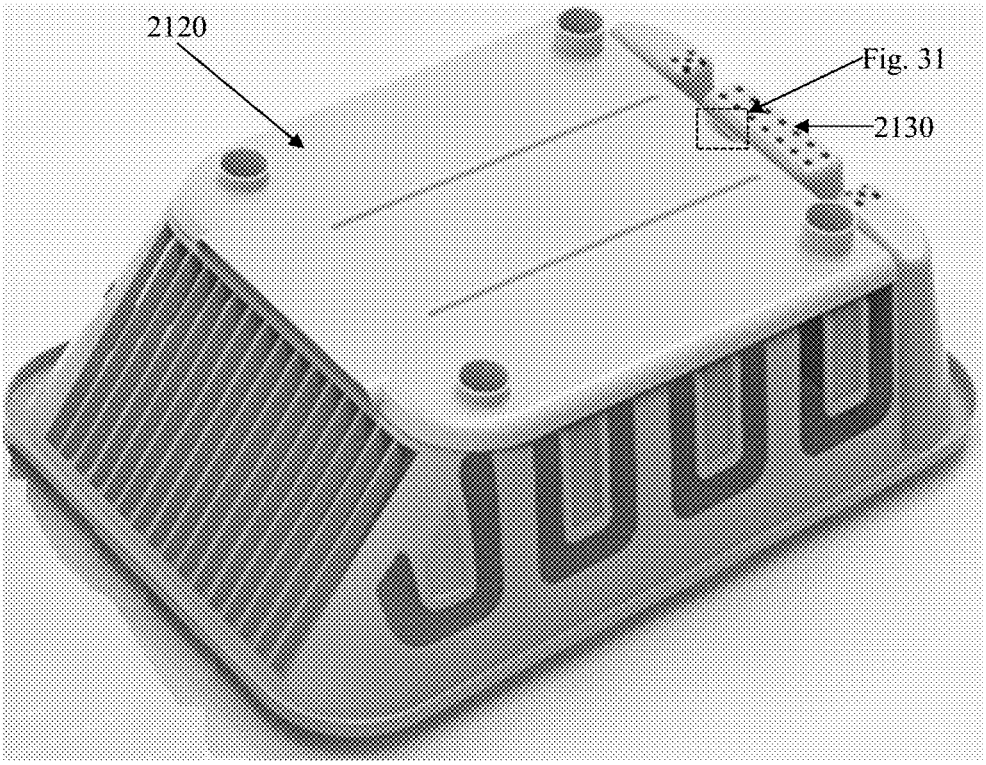
FIG. 30 is a bottom view of the nesting, dish drying rack of FIG. 21 in the second configuration.
Figure 31:
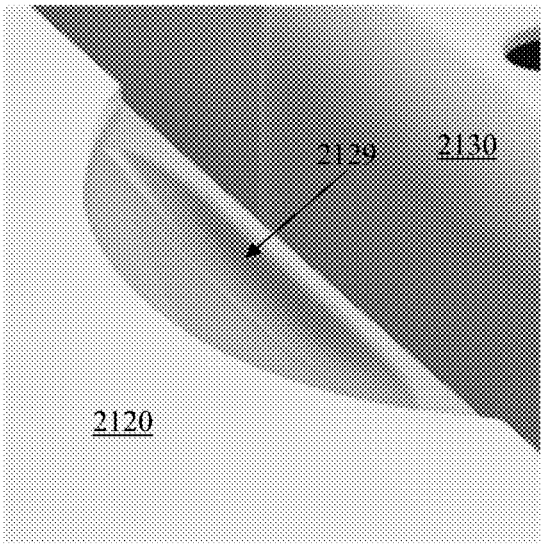
FIG. 31 is a close-up view of the baseboard extension handle of the nesting, dish drying rack of FIG. 21 in the second configuration.

FIG. 21 is a first view of a nesting, dish drying rack 2100 in accordance with a further embodiment, the nesting, dish drying rack 2100 being in a first configuration 2102 where an extension 2126 of the baseboard 2120 is extended beneath the utensil holding area 2130 so as to catch any water dripping from the utensil holding area 2130 while in use. FIG. 22 is another view of the nesting, dish drying rack 2100, the nesting, dish drying rack 2100 being in a second configuration 2104 where the extension 2126 of the baseboard 2120 is retracted. FIGS. 23-31 are additional views of the nesting, dish drying rack 2100.

As shown, the drying rack 2100 includes an upper portion 2110 and a baseboard 2120. The upper portion 2110 features a utensil holding area 2130 secured by drying area divider 2140. Beneath the drying area divider 2140 is a gap 2134 which allows drying racks 2100 to be nested.

The upper portion 2110 may also include feet 2114, e.g., a plurality of upper, alignment features defining protrusions. These feet 2114 may securely attach to protrusions 2170, e.g., a complementary plurality of lower, alignment features defining receptors, of the baseboard 2120. This ensures alignment of the upper portion 2110 and the baseboard 2120 and may also prevent accidental separation of the drying rack 2100.

The baseboard 2120 includes baseboard feet 2122 and a spout 2124. The extension 2126 is able to retract within the baseboard 2120 to expose the gap 2134 and facilitate nesting. In this non-limiting embodiment, the baseboard 2120 includes tracks 2160 and the extension 2126 includes track mounts 2162 which are configured to smoothly glide along the tracks 2160 to ease in extending/retracting the extension 2126. The extension 2126 may also include a handle 2129 to assist in retracting the extension 2126, for example, a projection and/or recess.

Figure 32:
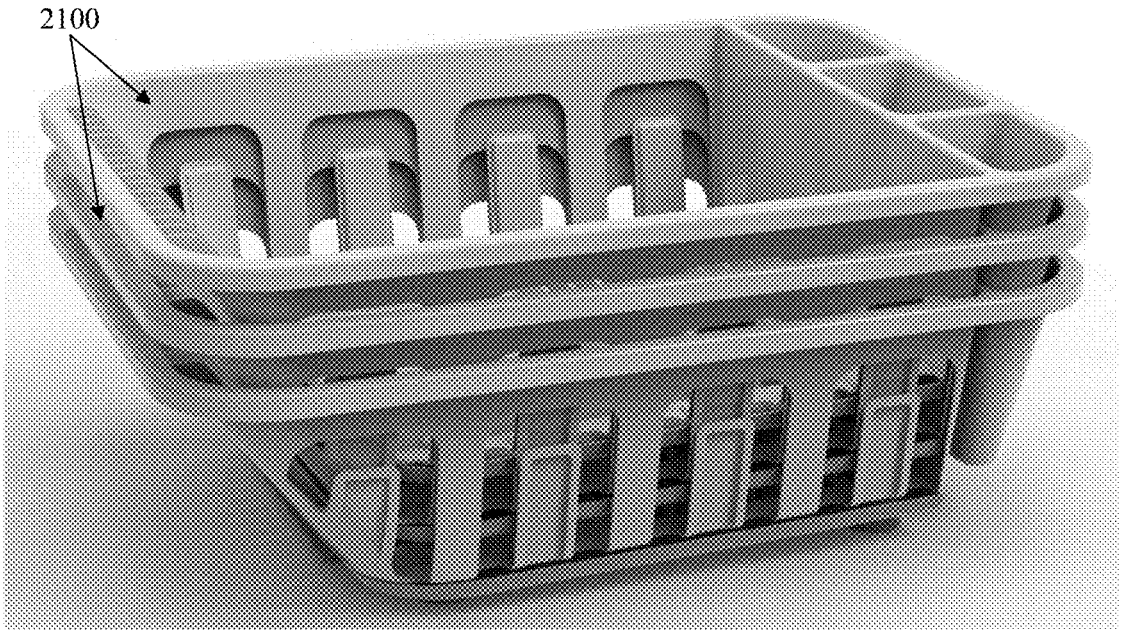
FIG. 32 is a view of three nesting, dish drying racks of FIG. 21, where the nesting, dish drying racks have been nested.

FIG. 32 is a view of three nesting, dish drying racks 2100 where the nesting, dish drying racks 2100 have been nested.

The foregoing description has been directed to particular embodiments. However, other variations and modifications may be made to the described embodiments, with the attainment of some or all of their advantages. Modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

What is claimed is:

1. A drying rack comprising:

an upper portion having a first drying area and a second drying area, wherein the first drying area and the second drying area define a gap between a lower extent of the first drying area and a lower extent of the second drying area;

a baseboard portion configured to catch liquid draining through the first drying area; and a baseboard extension configured to move between a first position and a second position, wherein:

in the first position, the baseboard extension extends beneath the second drying area so as to catch liquid draining through the second drying area, and in the second position, the baseboard extension at least partially overlaps the baseboard portion and does not extend beneath the gap between the lower extent of the first drying area and the lower extent of the second drying area so as to enable nesting of the drying rack with other like-designed drying racks.

2. The drying rack of claim 1, wherein the baseboard portion comprises a plurality of feet.

3. The drying rack of claim 2, wherein the feet include a non-slip surface.

4. The drying rack of claim 2, wherein, when the drying rack is at rest upon a surface, the feet of the baseboard portion are configured to hold the baseboard portion parallel to the surface so as to retain liquid within the baseboard portion, and wherein the upper portion comprises a plurality of feet which are configured to hold the upper portion parallel to the surface when the drying rack is at rest upon the surface.

5. The drying rack of claim 1, wherein the baseboard extension defines a handle to enable extension of the baseboard extension.

6. The drying rack of claim 1, wherein the upper portion comprises a plurality of upper, alignment features, wherein the baseboard portion comprises a complementary plurality of lower, alignment features, and wherein each upper, alignment feature is configured to match with a lower, alignment feature so as to ensure proper alignment of the upper portion in relation to the baseboard portion.

7. The drying rack of claim 6, wherein the plurality of upper, alignment features comprise a plurality of protrusions and the plurality of lower, alignment features comprise a plurality of receptors.

8. The drying rack of claim 6, wherein the baseboard portion comprises at least one track surface, and wherein the baseboard extension comprises at least one slider, the at least one slider configured to glide over the at least one track surface when the baseboard extension moves between the first position and the second position.

9. The drying rack of claim 1, wherein the upper portion comprises a molded plastic frame.

10. The drying rack of claim 1, wherein the upper portion comprises a wire frame.

11. A drying rack comprising:

an upper portion having a first drying area and a second drying area, wherein the first drying area and the second drying area define a gap between a lower extent of the first drying area and a lower extent of the second drying area;

a baseboard portion configured to catch liquid draining through the first drying area; and a baseboard extension configured to move between a first position and a second position, wherein:

in the first position, the baseboard extension extends beneath the second drying area so as to catch liquid draining through the second drying area, and in the second position, the baseboard extension at least partially overlaps the baseboard portion and does not extend beneath the gap between the lower extent of the first drying area and the lower extent of the second drying area so as to enable nesting of the drying rack with other like-designed drying racks, wherein the baseboard portion comprises a plurality of feet, wherein the baseboard portion further comprises a spout, and wherein, when the drying rack is at rest upon a surface, the feet are configured to hold the baseboard portion at an angle to the surface so as to allow the liquid to flow out through the spout.

12. The drying rack of claim 11, wherein the feet include a non-slip surface.

13. The drying rack of claim 11, wherein the baseboard extension defines a handle to enable extension of the baseboard extension.

14. The drying rack of claim 11, wherein the upper portion comprises a plurality of upper, alignment features, wherein the baseboard portion comprises a complementary plurality of lower, alignment features, and wherein each upper, alignment feature is configured to match with a lower, alignment feature so as to ensure proper alignment of the upper portion in relation to the baseboard portion.

15. The drying rack of claim 14, wherein the plurality of upper, alignment features comprise a plurality of protrusions and the plurality of lower, alignment features comprise a plurality of receptors.

16. The drying rack of claim 14, wherein the baseboard portion comprises at least one track surface, and wherein the baseboard extension comprises at least one slider, the at least one slider configured to glide over the at least one track surface when the baseboard extension moves between the first position and the second position.

17. The drying rack of claim 11, wherein the upper portion comprises a molded plastic frame.

18. The drying rack of claim 11, wherein the upper portion comprises a wire frame.

* * * * *